US005619188A

United States Patent [19]

Ehlers

[11] Patent Number: 5,619,188

[45] Date of Patent: Apr. 8, 1997

[54] PROXIMITY SENSOR WHICH IS SENSITIVE TO A PULSATING MAGNETIC FIELD

[75] Inventor: Wayne L. Ehlers, Lanark, Ill.

[73] Assignee: Honeywell Inc., Minneapolis, Minn.

[21] Appl. No.: 545,992

[22] Filed: Oct. 20, 1995

[51] Int. Cl.[6] ..... G08B 21/00

[52] U.S. Cl. ..... 340/686; 340/679; 340/687; 340/547; 340/545; 200/61.62

[58] Field of Search ..... 340/686, 679, 340/687, 547, 545; 200/61.62

[56] References Cited

U.S. PATENT DOCUMENTS

| | | | |
|---|---|---|---|
| 3,924,257 | 12/1975 | Roberts | 340/686 |
| 3,975,723 | 8/1976 | Bowling et al. | 340/686 |
| 4,319,236 | 3/1982 | Brace et al. | 340/679 |
| 4,349,814 | 9/1982 | Akehurst | 340/679 |
| 4,438,430 | 3/1984 | Young et al. | 340/547 |
| 4,806,910 | 2/1989 | Salzer | 340/547 |
| 5,353,015 | 10/1994 | Robinson | 340/686 |
| 5,455,562 | 10/1995 | Chin | 340/547 |
| 5,473,310 | 12/1995 | Ko | 340/547 |

*Primary Examiner*—Jeffery Hofsass

*Assistant Examiner*—Benjamin C. Lee

*Attorney, Agent, or Firm*—William D. Lanyi

[57] ABSTRACT

A proximity sensor is provided with a means for sensing an attempt to tamper with the normal operation of a proximity sensor. An Eddy current killed oscillator is used to sense the presence of an undulating magnetic field provided by a coil and a monolithic timing circuit that periodically energizes and deenergizes the coil. A sensing coil is association with an Eddy current killed oscillator to provide an output signal that undulates in response to the undulations of the magnetic field provided by the stationary coil. If the output signal from the Eddy current killed oscillator changes states at a sufficient frequency to continually refresh a retriggerable resettable multivibrator, an output from the multivibrator will remain in a high condition and represent the coincident positions of the zones proximate the output coil and sensing coil. If, on the other hand, an attempt is made to tamper with the sensor by placing a metallic object near the sensing coil, the constant output from the Eddy current killed oscillator will fail to trigger the multivibrator at a sufficient frequency to maintain the high status of its Q output. In addition, the outputs from the Eddy current killed oscillator and the multivibrator are combined to determine that a tamper attempt has been made.

20 Claims, 5 Drawing Sheets

PROXIMITY SENSOR WHICH IS SENSITIVE TO A PULSATING MAGNETIC FIELD

BACKGROUND OF THE INVENTION

1. Field of the Invention

The present invention is generally related to proximity sensors and, more particularly, to a proximity sensor that is intended for detecting the open or closed status of a door and which utilizes a stationary portion that generates a pulsating magnetic field and a movable portion that is sensitive to that pulsating magnetic field.

2. Description of the Prior Art

Many different types of proximity sensors are known to those skilled in the art. One particular type of proximity sensor utilizes an eddy current killed oscillator, or ECKO, to detect the presence of a metal within a predefined detection zone. This type of proximity sensor is described below in conjunction with FIG. 1. One disadvantage in the use of certain proximity sensors, when they are applied for the purpose of detecting the closed status of a protective device, such as a door or a shield, is that they can be defeated by a tampering effort that places a metal object near the sensing coil of the proximity sensor for the purpose of simulating the door's closure. In other words, if someone desires to defeat the safety purposes of the proximity sensor and operate a machine with its protective door in an open position, this type of tampering effort can be attempted by placing a metal object next to the sensing coil of the proximity sensor with the protective door open so that the proximity sensor operates in the manner that it would operate if the door was closed. For this reason, many machine manufacturers are reluctant to incorporate proximity sensors as safety devices in the machines.

It would therefore be significantly beneficial if a proximity sensor could be provided in which a tampering attempt of this type could be detected and defeated.

SUMMARY OF THE INVENTION

The present invention provides a proximity sensor that comprises first and second devices that are movable relative to each other. In a typical application, the first device is attached to a stationary portion of a machine and the second device is attached to a movable portion of the machine. The first device comprises a first means for providing a first magnetic field within a first predefined zone. It also comprises a means for periodically energizing and deenergizing the first magnetic field at a predetermined frequency. The first providing means can comprise a coil wound around a ferromagnetic core and the energizing and deenergizing means can comprise a timing circuit that periodically causes an electrical current to flow through the coil.

The second device comprises a second means for providing a second magnetic field within a second predefined zone. In addition, the second device comprises a means for sensing a change in a predefined characteristic of the second magnetic field. As is known to those skilled in the art, an eddy current killed oscillator can be used to provide the second magnetic field within the second predefined zone and, in addition, to provide the means for sensing the change in a predefined characteristic of the second magnetic field.

The present invention also comprises a third means for providing a first output signal in response to the change in the predefined characteristic of the second magnetic field. Known proximity sensors that operate under the eddy current killed oscillator principle respond to a reduction in the amplitude of an oscillating waveform to provide such an output signal.

The present invention also comprises a means for determining if the second predefined zone is coincident with the first predefined zone and a fourth means for providing a second output signal when the first and second predefined zones are coincident with each other. In other words, the present invention provides a means for responding to the coincident positions of the first and second predefined zones rather than merely responding to the presence of a metallic object within the second predefined zone.

In a particularly preferred embodiment of the present invention, the energizing and deenergizing means comprises a means for generating a first series of pulses that are used to control the current flowing through a transistor which, in turn, has its emitter and collector connected in series with the coil that is used to provide the first magnetic field.

An important feature of one particularly preferred embodiment of the present invention is a means for detecting an attempt to tamper with the sensor. In other words, if a metallic object is manually placed in the second predefined zone, rather than the coincident positioning of the first and second predefined zones, an output signal is provided that indicates this tampering attempt.

A typical application of the present invention is in conjunction with a machine that could possibly present a hazardous condition if the machine is operated without certain safeguards in place. In other words,. the machine can be a punch press, a lathe or some other type of industrial equipment that could present a possible hazard to the machine operator. The protective device could be a door or other safe guard that is movable with respect to a stationary part of the machine. The purpose of the safe guard is to prevent an operator from either walking into a hazardous position or extending an arm or leg into a hazardous position.

The first device of the present invention would be attached to the stationary part of the machine and a second device of the present invention would be attached to the door movable or safeguard. When the door is closed, the first and second predefined zones are placed in coincident relation with each other and the output signal from the second device of the present invention would be used to permit the operation of the machine. If an attempt is made to tamper with the normal operation of the proximity sensor, a tamper indicating output would be provided.

DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
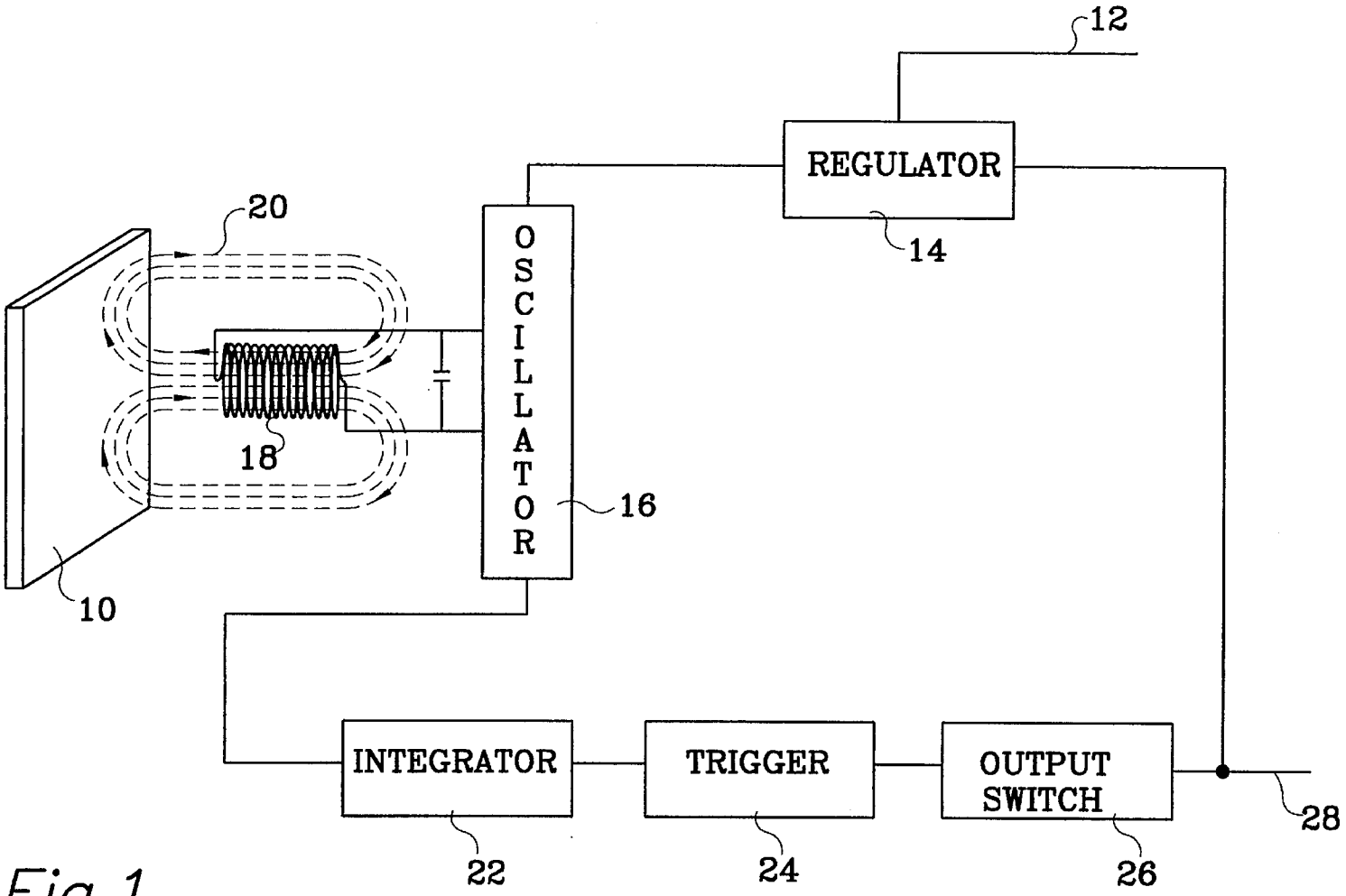
Fig. 1 (PRIOR ART)
FIG. 1 is an illustration of a proximity sensor that is known to those skilled in the art.

Throughout the Description of the Preferred Embodiment of the present invention, like components will be identified by like reference numerals.

FIG. 1 shows a proximity sensor that operates according to the eddy current killed oscillator (ECKO) principle and which is known by those skilled in the art. FIG. 1 is a simplified diagram that shows the proximity sensor disposed near a metallic target 10. Input power is provided at line 12 to a regulator 14 which maintains a constant supply voltage for the sensor despite possible variations in the supply voltage 12. The oscillator 16 is used to generate a radio frequency signal to a coil 18 which, in turn, provides a magnetic field 20., When a metallic target 10 is placed in the region of the magnetic field 20, Eddy currents are established within the metal in response to the presence of the magnetic field and the oscillations provided by the oscillator 16 are significantly reduced, or killed. The integrator 22 converts the sine wave signal generated by the oscillator into a DC signal. The DC signal varies in amplitude in response to the amplitude of the oscillating signal provided by the oscillator 16. This variation in amplitude of the DC signal is sensed by a Schmitt trigger 24 and converted to a digital signal. The digital signal from the Schmitt trigger 24 is then used to provide power to an output transistor 26. An output signal is provided on line 28 that indicates whether or not a metallic target is disposed within the detection zone of the coil 18. ECKO sensors are well known to those skilled in the art and are available in commercial quantities from the MICRO SWITCH division of the Honeywell Corporation.

Figure 2:
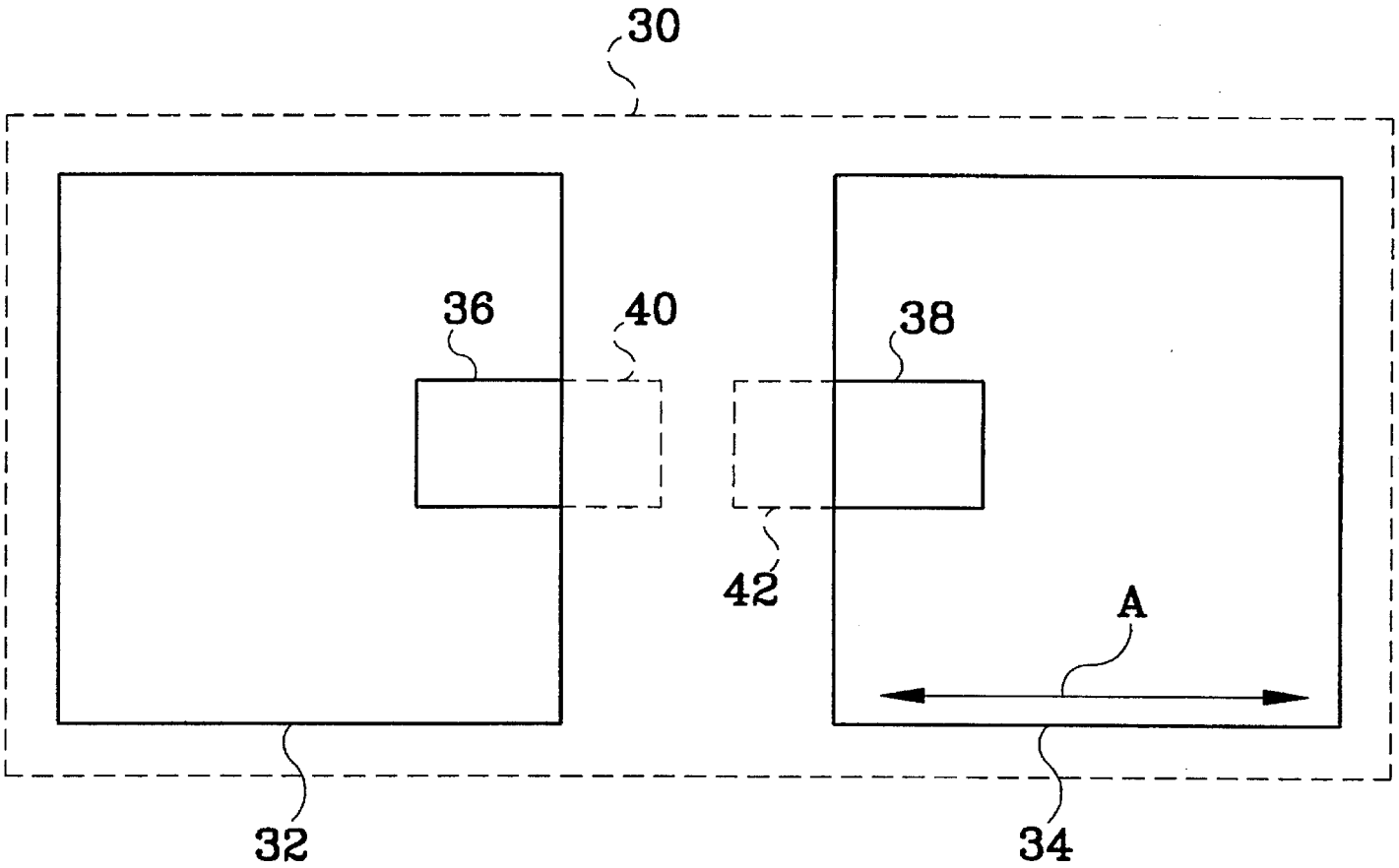
FIG. 2 is a schematic representation of a machine having stationary and moving parts that are associated with the first and second devices of the present invention.

FIG. 2 is a highly simplified schematic representation of a machine 30 that comprises a stationary portion 32 and a movable portion 34. As represented by arrow A, the movable portion 34 can move back and fourth with respect to the stationary portion 32. The present invention comprises a first device 36 that can be attached to the stationary portion 32 and a second device 38 that can be attached to the movable portion 34. As represented by the dashed lines in FIG. 2, the first device 36 provides a first magnetic field within a first zone 40 and the second device 38 provides a second magnetic field in a second zone 42. As will be described in greater detail below, the present invention senses the coincident position of the first and second zones, 40 and 42, in order to determine that the movable member 34 is in a proper position with respect to the stationary portion 32. In other words, the present invention provides a means for determining whether or not a safety device is properly in place so that the operation of the machine 30 can be permitted.

As described above, certain attempts to tamper with the machine are possible. For example, with the movable member 34 placed in a position that does not provide its intended safety function, a metallic object can be placed within the second zone 42 in an attempt simulate the closure of the movable member 34. However, the present invention defeats this type of tamper attempt by utilizing the first and second zones, 40 and 42, and requiring that the two zones be coincident with each other before the operation of the machine 30 is permitted.

Figure 3:
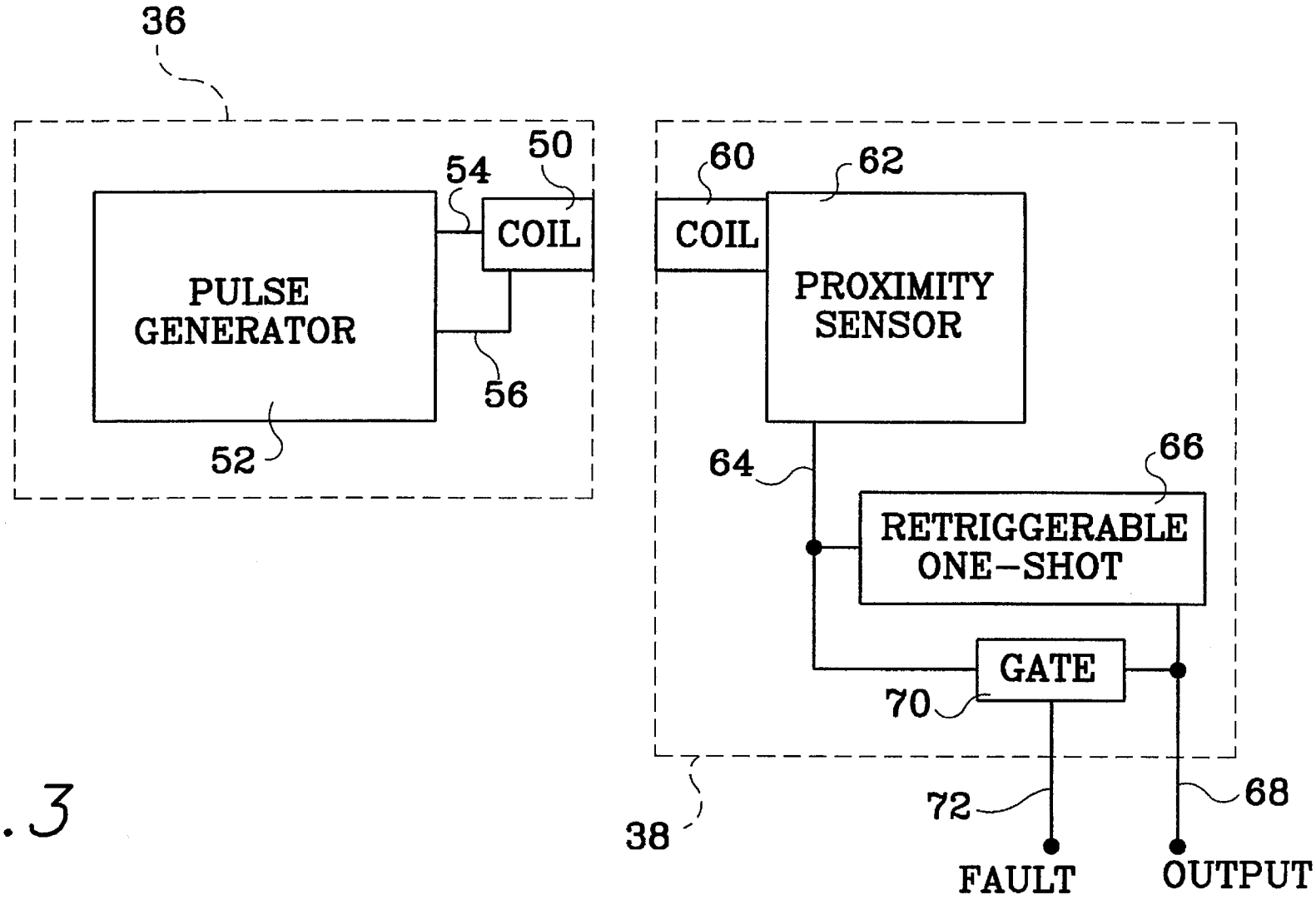
FIG. 3 is a schematic representation of the present invention.

With reference to FIG. 3, the first device 36 comprises a means for providing a first magnetic field in the first zone described above. That function is performed by a first coil 50. It also comprises a means for energizing and deenergizing the magnetic field of the first coil 50. In a preferred embodiment of the present invention, the energizing and deenergizing means is a monolithic timing circuit such as that which is identified as Catalog number TLC555 and is available in commercial quantities from Texas Instruments Incorporated. The pulse generator 52 is connected to the coil 50 by wires 54 and 56. The provision of an oscillating waveform, such as a square wave, though the coil 50 creates a periodic magnetic field in the first zone proximate the first coil 50.

With continued reference to FIG. 3, the second device 38 of the present invention comprises a sensing coil 60 that operates in a manner similar to the coil 18 described above in conjunction with FIG. 1. In addition, the proximity sensor 62 is associated with the coil 60 in the manner described above in conjunction with FIG. 1. In other words, the proximity sensor 62 comprises a regulator, an oscillator, an integrator, a Schmitt trigger and an output transistor that are combined to provide an output signal on line 64. The output signal from the proximity sensor 62 is connected to a retriggerable one shot 66. The retriggerable one shot 66 can be a retriggerable resettable multivibrator such as that identified as Catalog number HD74AC4538 which available in commercial quantities from Hitachi. The retriggerable one shot 66 provides a signal on line 68 that operates as an output signal of the present invention and also is connected to a gate 70 which combines the signal on line 68 with the signal on line 64 to determine whether or not a tampering attempt has been made. In other words, the output signal on line 68 signifies whether or not the first and second zones of the first and second magnetic fields are coincident with each other and the signal on line 72 signifies whether or not a tamper attempt has been made.

Figure 4:
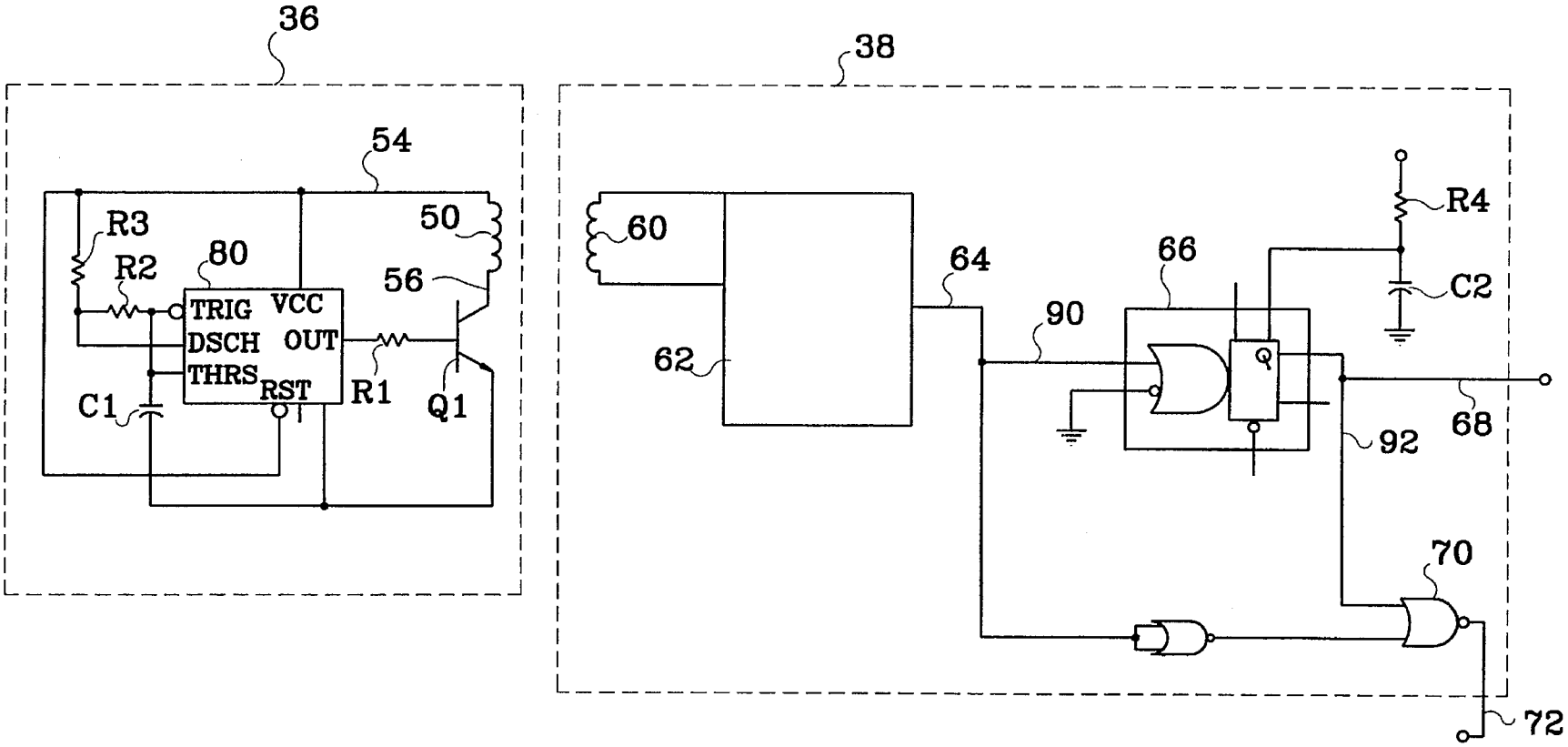
FIG. 4 is a more detailed representation of the circuitry used in a preferred embodiment of the present invention.

FIG. 4 is a more detailed schematic representation of the present invention. The dashed lines represent the first and second devices, 36 and 38, of the present invention as described above in conjunction with FIG. 3. Lines 54 and 56 show the connection between the pulse generating circuit and the coil 50. The pulse generating circuit comprises the monolithic timing circuit 80 that has an output connected to the base of transistor Q1 through resistor R1. The threshold input of the monolithic timing circuit 80 is connected to ground through comparator C1. When the output from the timing circuit 80 is high, current is conducted through the collector and emitter of transistor Q1 and through the coil 50. During the periods of time when the output from the timing circuit 80 is high, a magnetic field is generated by the coil 50 within a first zone proximate the face of the first device 36 in the region of the first coil 50. The second coil 60 of the proximity sensor 62 operates in the manner described above in conjunction with FIGS. 1 and 3. An output signal from the proximity sensor is provided on lines 64 and 90 to a retriggerable one shot. The retriggerable one shot 66, which can be a retriggerable resettable multivibrator such as that identified as Catalog item HD74AC4538 and described above, will not be discussed in detail herein because of the general familiarity of those skilled in the art with this device and its commercial availability. This device responds to periodic inputs on line 90 that occur at a frequency greater than the timing constant provided by the RC network comprising resistor R4 and compactor C2. In other words, if the pulses on line 90 are sufficiently frequent, an output signal from the Q output of the retriggerable one shot 66 will remain continually high on line 92. If, on the other hand, the signal on line 90 does not change magnitude at a frequency at least as great as the time constant of the RC circuit, the Q output on line 92 will be low.

With continued reference to FIG. 4, the output from the proximity sensor 62 on line 64 is also provided to the gate 70. The combination of the signals on lines 92 and 64 provides a fault indication when the signal on line 64 stops pulsing and maintains either a continuous high or a continuous low signal.

Figure 5:
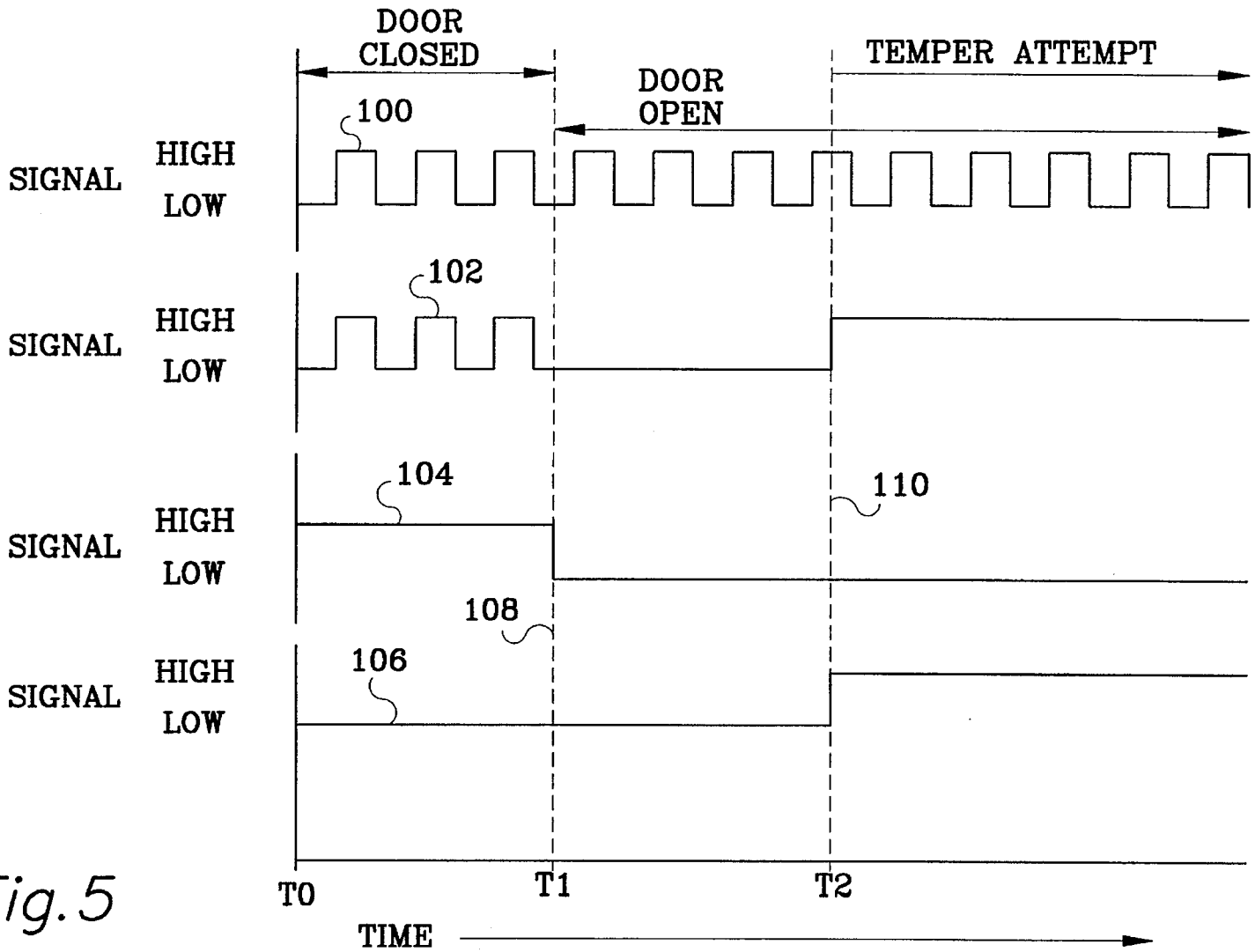
FIG. 5 is a timing diagram showing the operation of the present invention.

FIG. 5 is a timing diagram that shows the relative changes in the signals at various circuit points in FIG. 4. Signal 100 is a square wave signal provided at the output of the monolithic timing circuit 80 in FIG. 4. This signal 100 controls the conduction status of transistor Q1 and, in turn, the energization and deenergization of the magnetic field provided by the first coil 50. Signal 102 in FIG. 5 is the output of the proximity sensor 62 on line 64. It should be understood that the output from the proximity sensor on line 64 could be inverted by a simple modification of its internal circuitry. However, for purposes of this discussion, it will be assumed that the output signal on line 64 is high when the sensing coil 60 senses the existence of a magnetic field emanating from coil 50. This same high output would be provided on line 64 if a metallic target is placed in the detection zone of the second coil 60. During the period of time from time T0 to time T1, the signal on line 64 is an undulating signal 102 that corresponds to the energization and deenergization of the first coil 50 as represented by signal 100. Since the signal on line 90 to the retriggerable resettable multivibrator 66 is periodic and at a frequency that changes the status at the input of the multivibrator 66 faster than the timing constant provided by resistor R4 and capacitor C2, the Q output on line 92 remains high as represented by signal 104 in FIG. 5. The combination of the signals on lines 92 and 64, to the gate 70, result in a fault indication 104 that remains low through the time period between T0 and T1. This time period, as shown in FIG. 5, represents a condition with the door closed or, in other words, a condition where the first and second zones are coincident with each other. In other words, the first coil 50 and the second coil 60 are proximate each other and their respective magnetic fields are essentially coincident with each other. Beginning at time T0, as represented by line 108 in FIG. 5, the door is opened and the first and second zones are moved apart from each other. As a result, the output of the proximity sensor remains low as indicated by signal 102. In addition, the Q output on line 92 remains low because the signal on line 90 is continuously low to indicate the absence of any metallic target or magnetic field in the second zone of the second coil 60.

With continued reference to FIG. 5, the situation changes at time T2, as indicated by dashed line 110 to indicate that an attempt is made to tamper with the detector. The tampering attempt begins at time T2 and could represent the placement of a metallic object at the face of the second device 38 near the second coil 60.. The output from the proximity sensor 62, as represented by signal 102, changes to a high state as would be expected. However, since the signal on lines 64 and 90 remains high, the Q output on lines 68 and 92 will remain low because the frequency of the signal on line 90 is not sufficiently high to satisfy the conditions required by the timing network of resistor R4 and capacitor C2. The output from gate 70 therefore indicates a fault by providing a high signal 106 on line 72.

In FIG. 4, the signal on line 68 represents the status of the sensor which indicates whether or not the door is properly closed and that the second coil 60 is near the first coil 50. In other words, when the two zones are coincident with each other, the output on line 68 is high as represented by signal 104 in FIG. 5. When the two zones are not coincident with each other, the Q output on line 68 is low as represented by signal 104 in FIG. 5. If a tamper attempt is made, this is indicated by a high output on line 72 as represented by signal 106 in FIG. 5.

Therefore, it can be seen that the present invention provides a proximity sensor that is capable of detecting a tampering attempt and, in addition, is capable of defeating the tampering attempt.

The embodiments of the invention in which an exclusive property or right is claimed are defined as follows:

1. A proximity sensor, comprising:

a first device comprising a first means for providing a first magnetic field within a first predefined zone;

means, connected in signal communication with said first providing means, for periodically energizing and deenergizing said first magnetic field at a predetermined frequency;

a second device comprising a second means for providing a second magnetic field within a second predefined zone;

means, connected in signal communication with said second providing means, for sensing a change in a predefined characteristic of said second magnetic field corresponding to said predetermined frequency;

third means, connected in signal communication with said sensing means, for providing a first output signal in response to said change in said predefined characteristic;

means, connected in signal communication with said third providing means, for determining if said second predefined zone is coincident with said first predefined zone based on said sensed change; and fourth means, connected in signal communication with said third providing means, for providing a second output signal when said first and second predefined zones are coincident with each other, said first device and said second device being movable relative to each other to cause or not to cause the coinidence of said first and second predefined zones.

2. The sensor of claim 1, wherein:

said first providing means comprises a first coil wound around a first ferromagnetic core.

3. The sensor of claim 1, wherein:

said second providing means comprises a second coil wound around a second ferromagnetic core.

4. The sensor of claim 1, wherein:

said first device is attached to a stationary machine and said second device is attached to a movable portion of said stationary machine.

5. The sensor of claim 1, wherein:

said energizing and deenergizing means comprises a timing circuit.

6. The sensor of claim 1, wherein:

said determining means comprises a retriggerable resettable multivibrator.

7. The sensor of claim 1, wherein:

said energizing and deenergizing means comprises a means for generating a first series of pulses.

8. The sensor of claim 7, wherein:

said first series of pulses comprises a plurality of square wave pulses.

9. The sensor of claim 1, further comprising:

means for detecting an attempt to tamper with said sensor.

10. The sensor of claim 9, wherein:

said detecting means comprises a means for determining when an attempt is made to simulate the appearance of said first and second zones being coincident with each other when they are not coincident with each other.

11. A proximity sensor, comprising:

a first device comprising a first means for providing a first magnetic field within a first predefined zone;

means, connected in signal communication with said first providing means, for periodically energizing and deenergizing said first magnetic field at a predetermined frequency;

a second device comprising a second means for providing a second magnetic field within a second predefined zone;

means, connected in signal communication with said second providing means, for sensing change in a predefined characteristic of said second magnetic field corresponding to said predetermined frequency;

third means, connected in signal communication with said sensing means, for providing a first output signal in response to said change in said predefined characteristic;

means, connected in signal communication with said third providing means, for determining if said second predefined zone is coincident with said first predefined zone based on said sensed change; and fourth means, connected in signal communication with said third providing means, for providing a second output signal when said first and second predefined zones are coincident with each other, said first device and said second device being movable relative to each other to cause or not to cause the coincidence of said first and second predefined zones; and means for detecting an attempt to tamper with said sensor.

12. The sensor of claim 11, wherein:

said first providing means comprises a first coil wound around a first ferromagnetic core.

13. The sensor of claim 11, wherein:

said second providing means comprises a second coil wound around a second ferromagnetic core.

14. The sensor of claim 11, wherein:

said first device, is attached to a stationary machine and said second device is attached to a movable portion of said stationary machine.

15. The sensor of claim 11, wherein:

said energizing and deenergizing means comprises a means for generating a first series of pulses.

16. The sensor of claim 15, wherein:

said first series of pulses comprises a plurality of square wave pulses.

17. A proximity sensor, comprising:

a first device comprising a first means for providing a first magnetic field within a first predefined zone, said first providing means comprising a first coil wound around a first ferromagnetic core;

means, connected in signal communication with said first providing means, for periodically energizing and deenergizing said first magnetic field at a :predetermined frequency, said energizing and deenergizing means comprising a means for generating a first series of pulses;

a second device comprising a second means for providing a second magnetic field within a second predefined zone;

means, connected in signal communication with said second providing means, for sensing change in a predefined characteristic of said second magnetic field corresponding to said predetermined frequency;

third means, connected in signal communication with said sensing means, for providing a first output signal in response to said change in said predefined characteristic;

means, connected in signal communication with said third providing means, for determining if said second predefined zone is coincident with said first predefined zone based on said sensed change;

fourth means, connected in signal communication with said third providing means, for providing a second output signal when said first and second predefined zones are coincident with each other, said first device and said second device being movable relative to each other to cause or not to cause the coincidence of said first and second predefined zones; and means for detecting an attempt to tamper with said sensor.

18. The sensor of claim 17, wherein:

said first series of pulses comprises a plurality of square wave pulses.

19. The sensor of claim 17, wherein:

said second providing means comprises a second coil wound around a second ferromagnetic core.

20. The sensor of claim 17, wherein:

said first device is attached to a stationary machine and said second device is attached to a movable portion of said stationary machine.

* * * * *